US005960505A

United States Patent [19]

Sanghoon et al.

[11] Patent Number: 5,960,505

[45] Date of Patent: Oct. 5, 1999

[54] APPARATUS FOR ELIMINATING SLUDGE IN PIPES

[75] Inventors: Shim Sanghoon; Lee Jongchel, both of Kyungsangnam-do, Rep. of Korea

[73] Assignee: Kukil Industries Co., Ltd., Kyungsangnam-do, Rep. of Korea

[21] Appl. No.: 08/896,493

[22] Filed: Jul. 18, 1997

[30] Foreign Application Priority Data

Jul. 23, 1996 [KR] Rep. of Korea ..... 96-22177
May 19, 1997 [KR] Rep. of Korea ..... 97-11065

[51] Int. Cl.[6] ..... B08B 9/04

[52] U.S. Cl. ..... 15/104.061; 15/104.16

[58] Field of Search ..... 15/104.061, 104.05, 15/104.062, 3.5, 3.51, 104.16, 104.18

[56] References Cited

U.S. PATENT DOCUMENTS

| | | | |
|---|---|---|---|
| 2,567,475 | 9/1951 | Hall | 15/104.061 |
| 3,939,519 | 2/1976 | Muirhead | 15/104.061 |
| 4,069,535 | 1/1978 | Cato | 15/104.061 |
| 4,083,074 | 4/1978 | Curtis | 15/104.061 |
| 4,509,222 | 4/1985 | Knapp | 15/104.061 |
| 4,603,449 | 8/1986 | Knapp | 15/104.061 |
| 5,305,488 | 4/1994 | Lyle | 15/104.16 |
| 5,437,073 | 8/1995 | Smith | 15/104.061 |
| 5,457,841 | 10/1995 | Minton | 15/104.61 |
| 5,626,682 | 5/1997 | Kobari et al. | 15/104.05 |
| 5,784,745 | 7/1998 | Saxon et al. | 15/104.061 |

FOREIGN PATENT DOCUMENTS

| | | | |
|---|---|---|---|
| 2944709 | 5/1981 | Germany | 15/104.061 |
| 1806873 | 4/1993 | U.S.S.R. | 15/104.061 |

*Primary Examiner*—Gary K. Graham
*Attorney, Agent, or Firm*—Dilworth & Barrese

[57] ABSTRACT

The sludge eliminating apparatus of the present invention consists of a plurality of metal cylinders having several protruding eliminating teeth and outflow passing grooves, a plurality of spacers positioned in-between metal cylinders, a supporting member having a water pressure plate and several circular plates each plate having several notches, the supporting member contacting one end of the last one of the metal cylinders, a fixing pin for penetrating and fixing the metal cylinders, the spacers and the supporting member, and an inserting hole formed at the center of the water pressure plate. The present invention can completely eliminate sludge remnant undetached from the protruding eliminating teeth's first scratching by a low pressure state in-between the circular plates generated by the conveying power of the apparatus and receiving higher water pressure. Further, the present invention can eliminate sludge in the pipes of the U-shaped heat exchanger by using a elastic supporting member. Moreover, the present invention can be used for pipes where the apparatus can not be directly and manually inserted in the pipes thereof due to the structural characteristics by using a rod inserted into an inserting hole formed in the water pressure plate.

4 Claims, 7 Drawing Sheets

【FIG. 1】
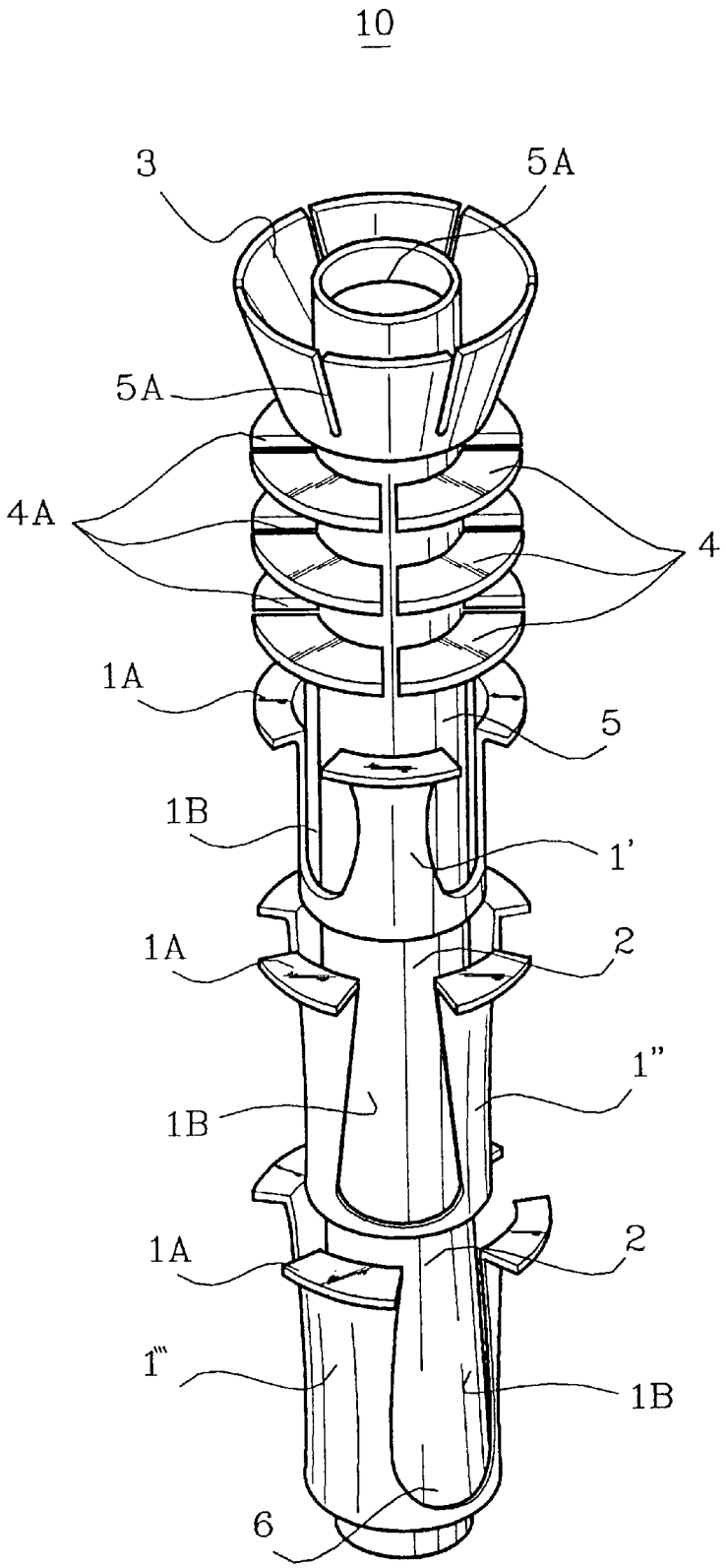

【FIG. 2】
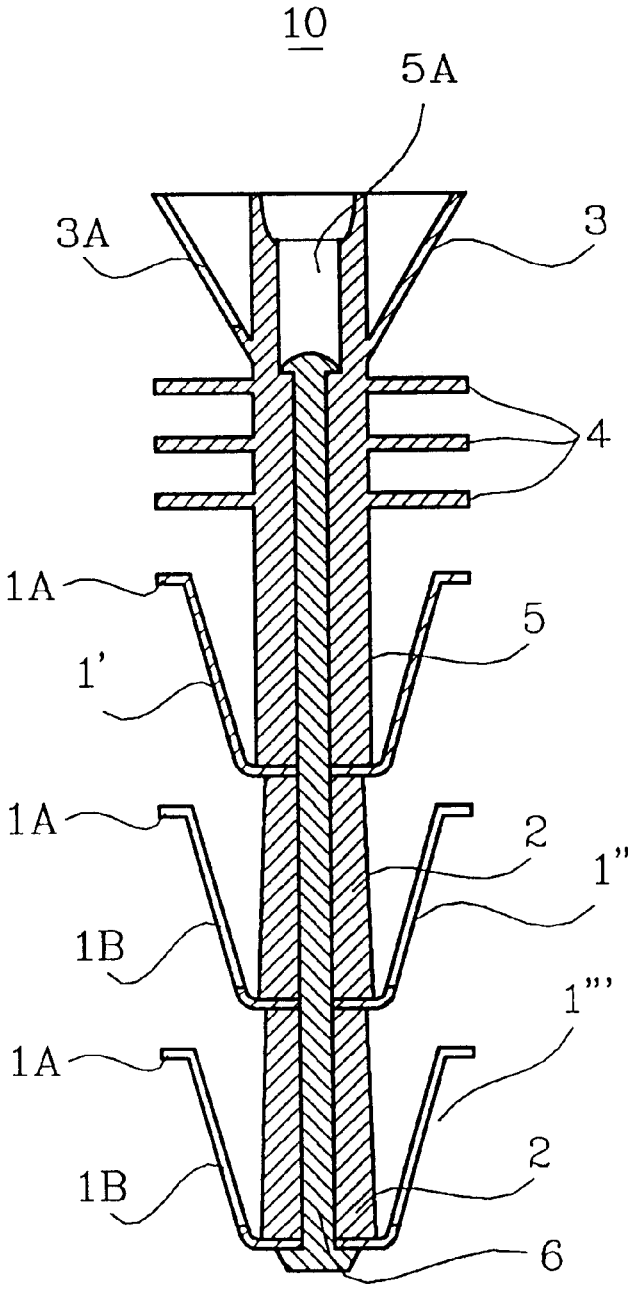

【FIG. 3】
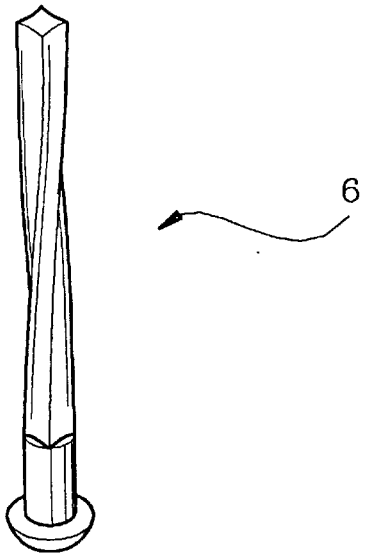
【FIG. 4】
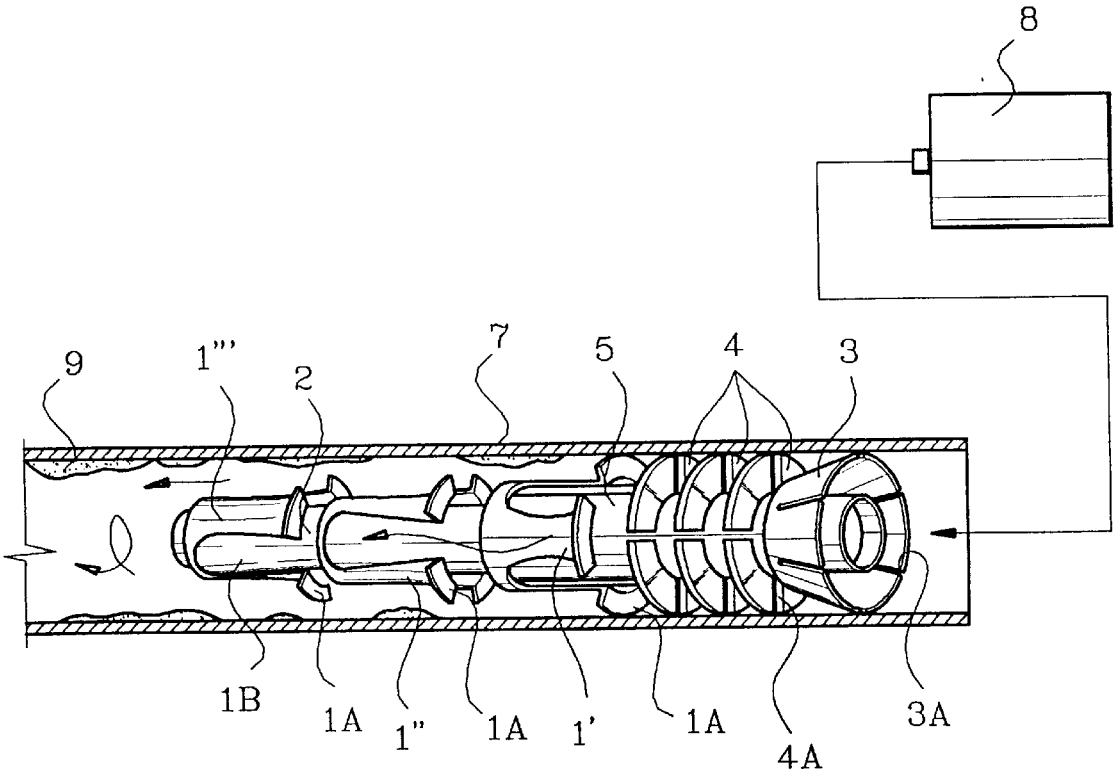

【FIG. 5】
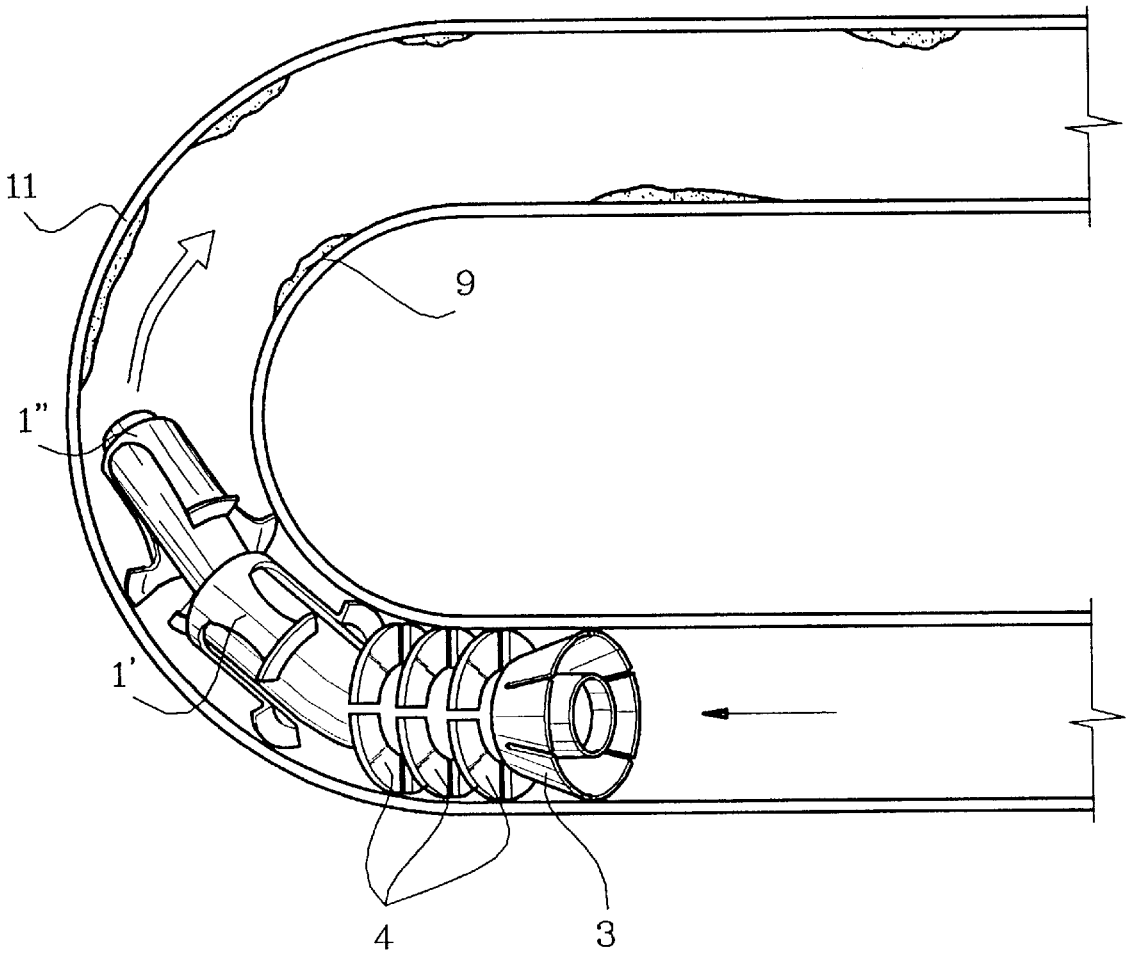

【FIG. 6】
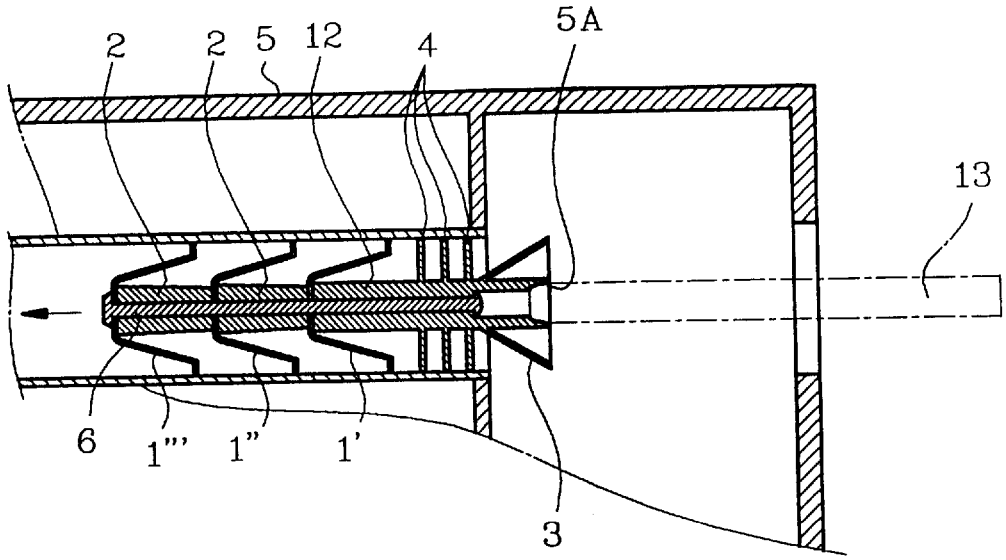
【FIG. 7】
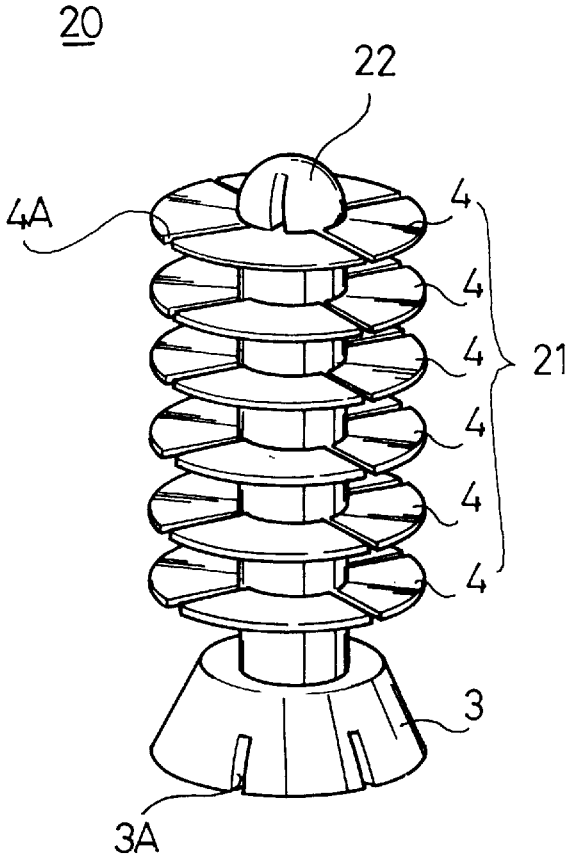

【FIG. 8】 PRIOR ART
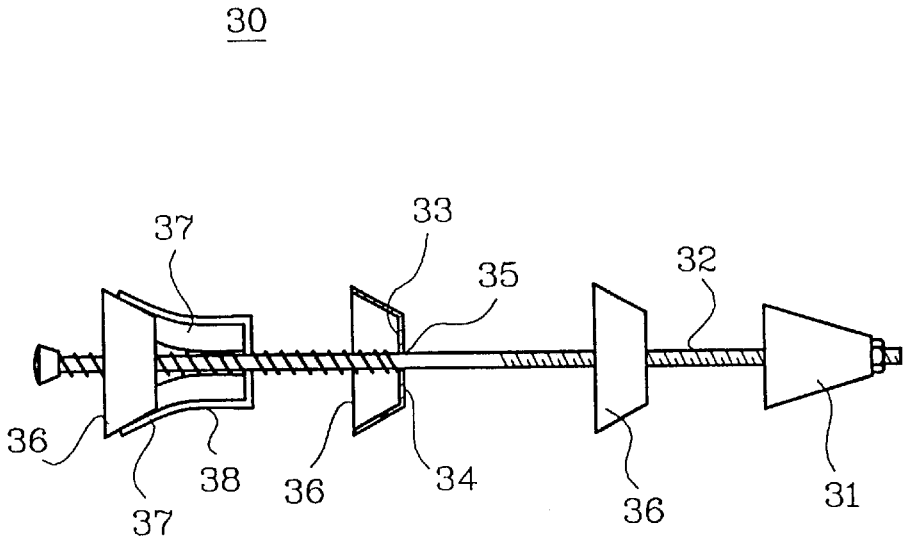
【FIG. 9】 PRIOR ART
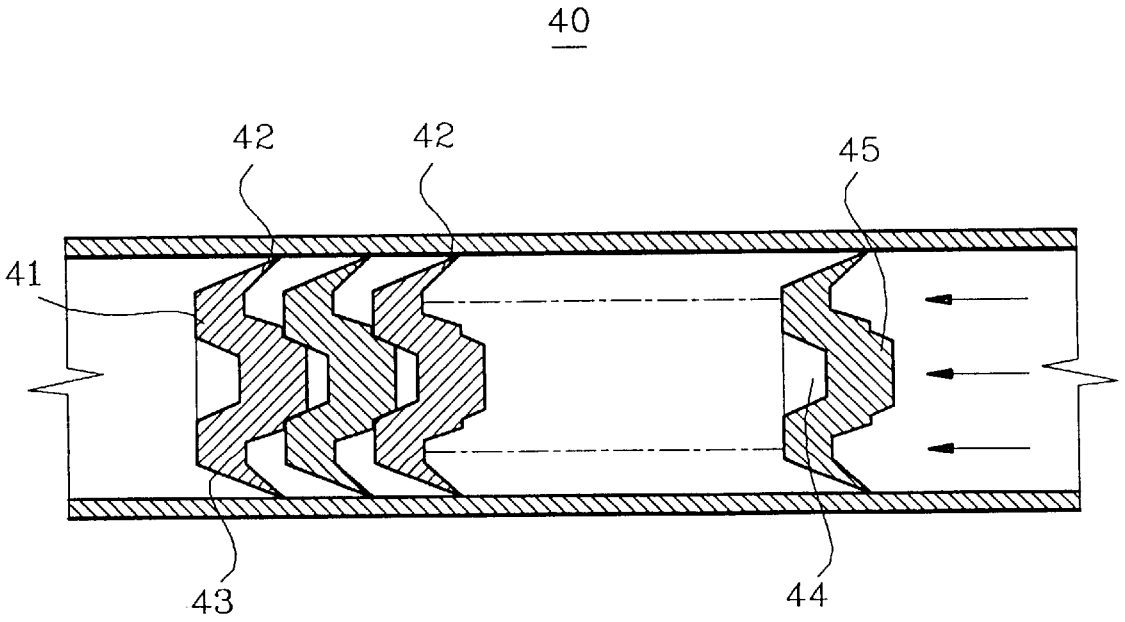

【FIG. 10】 PRIOR ART
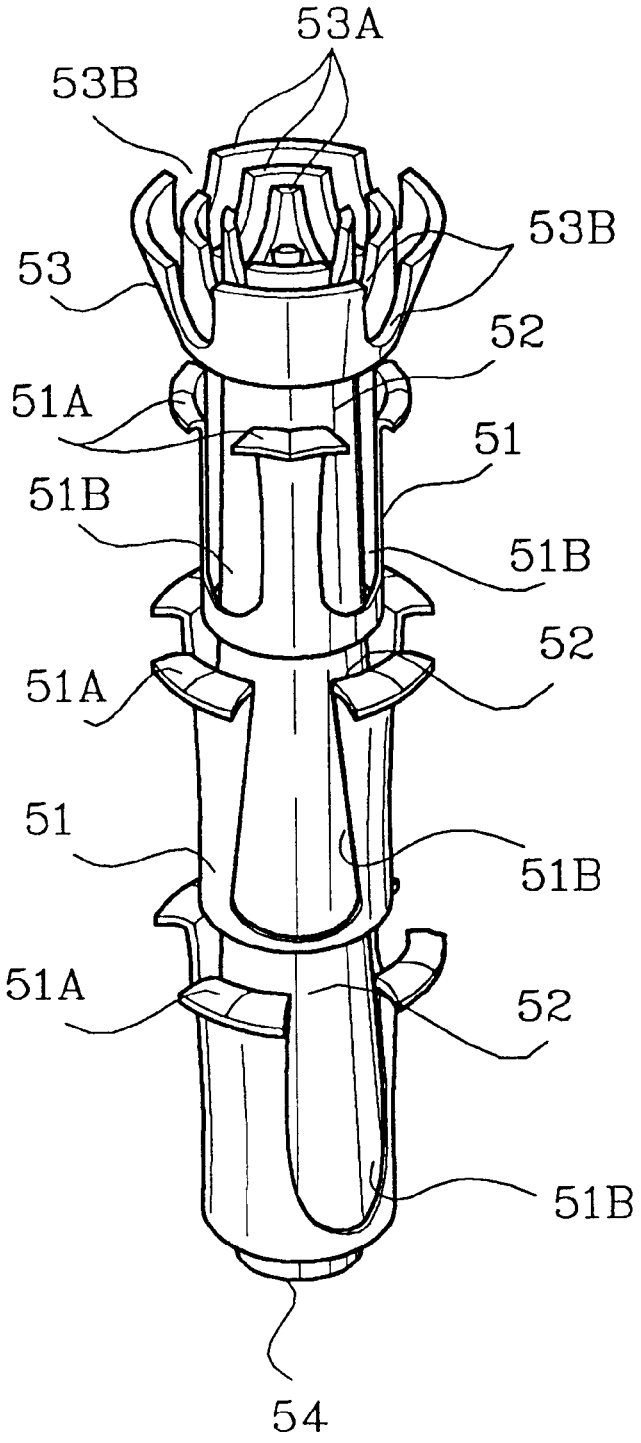

APPARATUS FOR ELIMINATING SLUDGE IN PIPES

FIELD OF THE INVENTION

The present invention relates to an apparatus for eliminating contaminating material in the pipe, and more particularly to an apparatus which can efficiently eliminate sludge, such as rusts or the like, attached on the inner surfaces of the pipes of heat exchangers for various fluid conveying.

BACKGROUND OF THE INVENTION

If sludge such as muds, viscous liquid materials, shells or the like is attached on the inner walls of the pipes of heat changers used in the petrochemical plants and power generating plants, they degrade efficiency of the heat exchangers and cause corrosion of the pipes to leak fluid from the pipes. Thus, it is necessary to periodically eliminate the sludge attached on the inner walls of the pipes in order to maintain the efficiency and lifetime of the heat exchangers.

Conventionally, the sludge on the inner surfaces of various fluid pipes is eliminated by scrubbing and cleaning the inner surfaces of the pipes with metal brush fixed at an end of a long stick or by rapidly flushing cleansing water containing chemicals or some high pressure water into pipes so that high pressure is applied onto the inner surfaces of the pipes with or without the use of any contaminant-eliminating apparatus.

However, in using metal brush, it is impossible to clean the inner surfaces of pipes long beyond the reach of the bar of the brush. When using only by rapidly flushing cleansing water containing chemicals or some high pressure water into pipes. The sludge which are hard fastened onto the inner surfaces of the pipes for a long time is likely to be left. In particular, the chemicals contained in the cleansing waters, it is important to remove the chemicals completely without any remaining after the cleaning of the sludge.

FIGS. 8, 9 and 10 show three conventional apparatuses for eliminating sludge on the inner surfaces of pipes.

The conventional sludge eliminating apparatus 30 shown in FIG. 8 is disclosed in Japanese Utility Model Publication sho 40-33657 (Nov. 25, 1965). The conventional sludge eliminating apparatus 30 consists of several bowl-shaped pressing plates 36 having on its bottom surface a plurality of passing holes 34 with respective control valves 33 on a screwed rod 32, a cap 31 of a truncated cone type placed at one end of the rod 32, and an extractor 38 having a plurality of elastic pieces petal-likely extended between the cap 31 and the plate 36, and in-between the plates 36.

Since the apparatus 30 has a complicated structure which can adjust the pressure of water applied onto the plates 36 by the operation of the control valves 33 attached to the plurality of passing holes 34 of the plates 36, large sized sludge can not be properly discharged. Further, since the space between elastic pieces of the extractor 38 is very narrow, the cleansing water passing through the passing holes 34 does not swirl but flow straightly in the pipes. Therefore, the sludge scratched off by the elastic pieces 37 and sludge incompletely scratched off and still remaining on the inner surfaces of the pipes can not be sufficiently taken along with the cleansing water out of the pipes.

The apparatus 40 shown in FIG. 9 is disclosed in Japanese laid-open Utility Model Publication sho 49-98062. The apparatus 40 comprises a cleaner member 43 having a circular plate portion 41 and a rib portion 42 taperingly protruding in the backward direction of the peripheral surface of the circular plate portion 41. A coupling hole 44 is formed at the front center of the circular plate portion 41 of the cleaner member 43 and a coupling protrusion 45 which can be coupled in the coupling hole 44 is formed at the back center of the circular plate portion 41 so that the cleaner members 43 can be connected in series according to the cleaning capacity of the apparatus 40.

In the apparatus 40, the rib portion 42 of the cleaner member 43 is closely contacted onto the inner surfaces of pipes by the pressure of water and then the cleaner member 43 is moved in the pipes, so that the sludge in the pipes can be scratched off. However, since the cleansing water can not smoothly flow in the moving direction of the cleaner member 43, the sludge being removed can not be rapidly discharged out along the cleaning water. Also, if large amount of the removed sludge is accumulated at the front of the cleaner member 43, the cleaner member 43 can hardly move forward due to the resistance of the accumulated sludge consequently the scratching force less applies to the sludge.

The apparatus 50 shown in FIG. 10 is disclosed in Korean Utility Model Application No. 18162 filed on Jul. 20, 1994 by the same applicant of this application and published. The apparatus 50 consists of several metal cylinders 51 provided with protrusive eliminating teeth 51A, a spacer 52 between the metal cylinders 51 in a truncated cone shape so that cleansing water flowing through the spacer 52 extends, a fixing pin 54 inserted into both the metal cylinder 51 and the spacer 52 to fix them at a certain position and a water pressure plate 53 having several concentric elastic pieces 53A of different diameters and several notches 53B for receiving higher water pressure. In the apparatus 50, the outflowing inserting grooves 51B formed in each of the metal cylinders 51 are arranged not to be placed in a straight row for passing cleansing water to swirl.

The apparatus 50 shown in FIG. 10 has higher efficiency in scratching off sludge attached in the pipes than the apparatuses 30 and 40 shown in FIG. 7 and 8 respectively having advantage that it moves smoothly in the pipes by receiving higher water pressure due to the water pressure plate 53 having several elastic pieces 53A with the inserting grooves 53B. However, in the apparatus 50, it is only the protrusive elimination teeth 51A that work for removing the sludge in the pipes. Therefore, if the teeth 51A fails to completely scratch off all sludge, some sludge is likely to remain in the pipe. Further, the apparatus 50 has not enough flexibility to be used for U-shaped pipes. Also, there is another problem that the apparatus 50 cannot be manually placed in a pipe of an heat exchanger when the heat exchanger's structure does not allow that.

SUMMARY OF THE INVENTION

It is an object of the present invention to provide an apparatus for completely eliminating sludge without remaining any part of the sludge from the inner surfaces of pipes after the protrusive eliminating teeth's scratching by adopting an water pressure plate and circular plates where high pressure water is applied to give bigger conveying force and a low pressure state occurs between circular plates.

Another object of the invention is to provide an apparatus for eliminating sludge in U-shaped pipes of heat exchangers by using a elastic supporting member having a water pressure plate and a plurality of circular plates.

Still another object of the invention is to provide an apparatus for eliminating sludge, which can be used in a heat exchanger in which such apparatus can not be directly and manually placed in the pipes thereof due to the heat exchanger's structural characteristics, by providing the apparatus with an inserting hole formed at the center of the water pressure plate so that a handling rod can be inserted into the hole.

In order to achieve the objects of the invention, an apparatus according to the invention comprises a plurality of metal cylinders having several protrusive eliminating teeth and outflow passing grooves, a plurality of spacers positioned in-between the respective metal cylinders, a supporting member having a water pressure plate and several circular plates in a body, each plate having several notches. The supporting member contacts one end of the metal cylinders, a fixing pin penetrating to fix metal cylinders, the spacers and the supporting member at certain positions, and an inserting hole formed at the center of the water pressure plate.

Here, it is characterized that the fixing pin is in twisted form, the supporting member has elasticity and the water pressure plate and circular plates are made of elastic synthetic resin.

The length of the fixing pin is shorter than the distance between the front most end of the apparatus and the front most end of the supporting member, the spacers are in the form of truncated cone and the metal cylinders are arranged in a way that the outflow passing grooves of respective metal cylinders are placed not to be in a straight row relating to the neighboring metal cylinders.

In order to achieve the objects of the present invention, another apparatus according to the present invention, comprises a water pressure plate which spreads receiving high pressure water to tightly contact the inner surfaces of a pipe, a low pressure generating portion having a plurality of circular plates where low pressure state occurs when high pressure water passes fast, and a supporting member having the water pressure plate and the low pressure generating portion in a body. Therefore, the apparatus according to the present invention completely eliminate sludge from the inner surfaces of the pipe by scratching off and sucking off the sludge on the inner surfaces when being moved by high water pressure.

Preferably, the water pressure plate and each of the circular plates have a plurality of notches and are made of a synthetic resins, and the supporting member has elasticity and has a inserting hole formed at the center of inner surface thereof so that the apparatus is combined with a rod in order to be placed into the pipe to be cleaned.

BRIEF DESCRIPTION OF THE DRAWINGS

For a complete understanding of the present invention, preferred embodiments according to the present invention will now be described in detail with reference to the accompanying drawings in which:

FIG. 1 is a perspective view illustrating an apparatus according to the present invention;

FIG. 2 is a sectional view illustrating the apparatus according to the present invention;

FIG. 3 is a perspective view illustrating a fixing pin for use in the apparatus according to the present invention;

FIG. 4 shows a first embodiment of the operation of the apparatus according to the present invention;

FIG. 5 shows a second embodiment of the operation of the apparatus according to the present invention;

FIG. 6 shows a third embodiment of the operation of the apparatus according to the present invention;

FIG. 7 is a perspective view of another apparatus according to the present invention;

FIG. 8 is an apparatus for eliminating sludge in pipes according to prior art;

FIG. 9 is another apparatus for eliminating sludge in pipes according to prior art; and FIG. 10 is still another apparatus for eliminating sludge in pipes according to prior art.

DETAILED DESCRIPTION OF THE INVENTION

The sludge eliminating apparatus of the present invention shown in FIGS. 1 and 2 consists of a plurality of metal cylinders 1', 1" and 1"' having several protrusive eliminating teeth 1A and outflow passing grooves 1B, a plurality of spacers 2 positioned between the respective metal cylinders 1', 1" and 1"', a supporting member 5 consisting of water pressure plate 3 and several circular plates 4 in a body contacting with one end of the metal cylinders 1', 1" and 1"', each plate having several notches 4A, a fixing pin 6 for penetrating to fix metal cylinders 1', 1" and 1"', spacers 2 and the supporting member 5, and a inserting hole 5A formed at the center of the water pressure plate 3.

The supporting member 5 has elasticity and the water pressure plate 3 and circular plates 4 is made of elastic synthetic resin. The length of the fixing pin 6 is preferably shorter than the distance between the front most end of the apparatus and the front most one of the plurality of circular plates 4 in order to secure flexibility. The spacers 2 are in the shape of truncated cone. The metal cylinders 1', 1" and 1"' are arranged in a way that the outflowing inserting grooves 1B in each of metal cylinders 1', 1" and 1"' is placed not in straight row related to one of the neighbouring cylinders.

As shown in FIG. 3, the fixing pin 6 is in the form of twist so that the metal cylinders 1', 1" and 1"' and the spacers 2 inserted by the fixing pin 6 can be fixed at a certain relational position.

The apparatus 20 shown in FIG. 7 in accordance with the present invention comprises a water pressure plate 3 which spreads when receiving high pressure water to tightly contact the inner surfaces of a pipe, a low pressure generating portion 21 having a plurality of circular plates 4 for taking sludge off from the inner surfaces of on the inner surfaces of the pipe when being moved by water pressure and generating low pressure state in-between the circular plates 4, and a supporting member 22 having the water pressure plate 3 and the low pressure generating portion 21 in a body.

The water pressure plate 3 and the circular plates 4 have a plurality of notches 3A and 4A respectively and are made of elastic synthetic resin. The supporting member 22 has elasticity and has an inserting hole formed at the inner surface thereof to accept an inserting rod so that the apparatus can be inserted on one end of the rod to be placed easily into the pipe to be cleaned.

The operation of the apparatus according to the present invention will be now described in detail with reference to the drawings.

FIG. 4 is a first embodiment of the operation of the apparatus 10 for eliminating sludge in accordance with the present invention. First, as shown in FIG. 4, in order to eliminate sludge attached on the inner surfaces of a pipe 7, the apparatus 10 is inserted in the pipe 7 and then a pump 8 is activated to apply high water pressure into the pipe 7. Thus, a water pressure plate 3 made of elastic synthetic resin spreads receiving the high pressure water so that the water pressure plate 3 tightly contacts the inner surfaces of the pipe 7. As the spreaded water pressure plate 3 receives more water pressure, the apparatus 10 moves into the pipe 7. When the apparatus 10 moves into the pipe 7, the sludge 9 attached on the inner surfaces of the pipe 7 is scratched off from the inner surfaces by the protruding eliminating teeth 1A of the apparatus 10 and discharged out along with some cleansing waters flushing out through the notches 3A of the water pressure plate 3, the notches 4A of the circular plates 4 and several outflow passing grooves 1B formed in each of metal cylinders 1', 11" and 1'".

Since the several outflow passing grooves 1B formed in each of metal cylinders 1', 11" and 1'" is arranged not to be placed in a straight row with respect to those of the neighbouring cylinder, the sludge 9 on the inner surfaces of the pipe 7 can be evenly removed. Further, since the cleansing water swirls strongly in the pipe 7 and flush out of the pipe 7, the sludge 9 can be easily discharged. Moreover, since the spacers 2 has the counter-tapered surface, the cleansing water spreads out.

Circular plates 5 are made of elastic synthetic resin, floating pressure (low pressure) occurs between the circular plates 5 by the conveying force of the apparatus 10 produced by high water pressure. Therefore, the floating pressure works to detach the sludge still remaining undetached after scratched by the teeth 1A and then the detached sludge is discharged out along with the cleansing waters, consequently the inner surfaces of the pipes 7 is cleaned again by the circular plates 4 and the water pressure plate 3.

FIG. 5 shows a second embodiment of the operation of the apparatus according to the present invention. Referring to FIG. 5, the apparatus 10 can be smoothly moved along the inner curved surfaces of a U-shaped pipe 11 owing to the elasticity of a supporting member 5 having an water pressure plate 3 and several circular plates 4 in a body so that it can easily remove the sludge on the inner walls of the U-shaped pipe 11 used in some heat exchanger. On the other hand, in order to increase the flexibility of the supporting member 5, the length of a fixing pin 6 is preferably shorter than the distance between the front most end of the apparatus 10 and the front most circular plates 4.

FIG. 6 is a third embodiment of the operation of the apparatus according to the present invention. As shown in FIG. 6, the apparatus 10 can be easily placed into pipe even if a heat exchange has some structural characteristics not to allow manual inserting of the apparatus into pipes, by using a rod 13 inserted into an inserting hole formed in core portion of the supporting member 5.

Referring to FIG. 7, the apparatus 20 according to another embodiment of the present invention has no metal cylinders 1', 1" and 1'" provided with several teeth 1A shown in the apparatus 10 of FIG. 1. The apparatus 20 comprises an water pressure plate 3 which spreads receiving high pressure water to tightly contact the inner surface of pipe, a low pressure generating portion 21 having a plurality of circular plates 4 for scratching sludge off from the inner surface of the pipe when being moved by water pressure and generating a low pressure state in-between the circular plates 4, and a supporting member 22 having the water pressure plate 3 and the low pressure generating portion 21 in a body. The operation of the apparatus 20 shown in FIG. 7 is similar to that of the apparatus 10 shown in FIG. 1. However, the apparatus 20 shown in FIG. 7 is for the inner surface of weak material, such as pipes made of copper, nickel alloy, titanium or bronze, for example. That is, if the apparatus 10 shown in FIG. 1 is used in order to eliminate the sludge in the pipes having weak inner surface, the inner surface of the pipes could be damaged by the teeth LA made of steel. Therefore, the apparatus 20 shown in FIG. 7 should be used for weak inner surfaces of the pipes to avoid damage in scratching the sludge off. Also, when the apparatus 20 is moved in the pipe by the water pressure, the sludge attached in the pipe is scratched off by the water pressure plate 3 and the circular plates 4 of the low pressure generating portion 21, and then discharged out along with the cleansing waters. Consequently the inner surfaces of the pipe can be cleaned.

Further, since the apparatus 20 can be smoothly moved along the U-shaped pipes due to the flexibility of the supporting member 22, it can easily remove the sludge attached in the pipe of U-shaped heat exchanger. The apparatus 20 can be easily put into the pipe by using a rod inserted in the inserting hole formed in the supporting member 22 when some structural problems of a heat exchanger does not allow the apparatus manually inserted into the pipe.

The present invention can completely eliminate sludge remnant undetached from the inner surfaces of pipes after protrusive eliminating teeth's scratching by taking off the remaining sludge with a low pressure state in-between circular plates generated by the conveying power of the apparatus and higher water pressure applied to water pressure plate and circular plates. Further, the present invention can eliminate sludge in the U-shaped pipes by using a elastic supporting member which includes a water pressure plate and several circular plates in a body. Moreover, the present invention can be used in a heat exchanger in which the apparatus can not be directly and manually inserted in the pipes thereof due to the structural characteristics by inserting the apparatus into the pipes using a rod inserted into a hole formed at the center of the water pressure plate.

What is claimed is:

1. An apparatus for eliminating sludge in pipes comprising:

a plurality of metal cylinders having several protrusive eliminating teeth and outflow passing grooves;

a plurality of spacers positioned in-between the respective metal cylinders;

a supporting member being in contact with the rear most one of the plurality of the metal cylinders and including an water pressure plate and a plurality of circular plates having several notches;

a fixing pin for penetrating to fix the metal cylinders, the spacers and the supporting member; and an inserting hole formed at the center of the water pressure plate of the supporting member.

2. An apparatus as set forth in claim 1, wherein the fixing pin is twisted about a longitudinal axis.

3. An apparatus as set forth in claim 1, wherein length of the fixing pin is shorter than distance between a front most end of the apparatus and a front most one of the plurality of the circular plates.

4. An apparatus as set forth in claim 1, wherein the water pressure plate and the circular plates are made of elastic synthetic resin.

* * * * *